US010113479B2

(12) United States Patent
Courtial et al.

(10) Patent No.: US 10,113,479 B2
(45) Date of Patent: Oct. 30, 2018

(54) VALVE MOTION MEASUREMENT ASSEMBLY FOR AN INTERNAL COMBUSTION ENGINE

(71) Applicant: GM GLOBAL TECHNOLOGY OPERATIONS LLC, Detroit, MI (US)

(72) Inventors: Alessio Courtial, Turin (IT); Luca Trabucchi, Turin (IT); Andrea Coltella, Oviglio (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 75 days.

(21) Appl. No.: 15/235,773

(22) Filed: Aug. 12, 2016

(65) Prior Publication Data

US 2017/0044977 A1 Feb. 16, 2017

(30) Foreign Application Priority Data

Aug. 13, 2015 (GB) ..... 1514404.1

(51) Int. Cl.
*F02B 77/08* (2006.01)

(52) U.S. Cl.
CPC ..... *F02B 77/082* (2013.01); *F01L 2820/04* (2013.01); *F01L 2820/041* (2013.01)

(58) Field of Classification Search
CPC .... G01M 15/042; G01M 15/00; G01M 15/02; G01M 15/04; G01B 21/26; F02B 77/082; F01L 2820/041; F01L 2820/04; Y02T 10/18; F02D 13/0207; F02D 2041/001
USPC ..... 123/188.2
See application file for complete search history.

(56) References Cited

U.S. PATENT DOCUMENTS

| | | | | |
|---|---|---|---|---|
| 4,945,766 | A | 8/1990 | Dahlmann et al. | |
| 5,675,676 | A | 10/1997 | Yamashita et al. | |
| 2001/0042566 | A1* | 11/2001 | Mori | F01L 1/46 137/554 |
| 2005/0011477 | A1* | 1/2005 | Yoeda | F01L 9/04 123/90.11 |
| 2009/0293597 | A1* | 12/2009 | Andrie | F01L 1/46 73/114.16 |

(Continued)

FOREIGN PATENT DOCUMENTS

| | | | |
|---|---|---|---|
| CN | 203148410 U | * | 8/2013 |
| DE | 4326379 A1 | | 2/1995 |

(Continued)

OTHER PUBLICATIONS

CN 203148410 U—English Translation.*
Great Britain Patent Office, Great Britain Search Report for Great Britain Application No. 1514404.1, dated Feb. 3, 2016.

*Primary Examiner* — Joseph Dallo
*Assistant Examiner* — Scott A Reinbold
(74) *Attorney, Agent, or Firm* — Lorenz & Kopf, LLP

(57) ABSTRACT

A valve motion measurement assembly is provided for a cylinder valve of an internal combustion engine provided with a valve stem and with a valve head. The valve motion measurement assembly includes a valve position sensor, a supporting bracket provided with at least one sensor seat for the valve position sensor, and a sensor target element configured to be coupled to the valve stem at a distance from the valve head to follow the motion of the cylinder valve. The valve position sensor interacts with the sensor target element for determining the position of the cylinder valve.

20 Claims, 12 Drawing Sheets

(56) References Cited

U.S. PATENT DOCUMENTS

2013/0233265 A1 9/2013 Zurface et al.

FOREIGN PATENT DOCUMENTS

| | | | |
|---|---|---|---|
| DE | 10214685 | A1 | 5/2003 |
| JP | 2000130122 | A | 5/2000 |

* cited by examiner

VALVE MOTION MEASUREMENT ASSEMBLY FOR AN INTERNAL COMBUSTION ENGINE

CROSS-REFERENCE TO RELATED APPLICATION

This application claims priority to British Patent Application No. 1514404.1, filed Aug. 13, 2015, which is incorporated herein by reference in its entirety.

TECHNICAL FIELD

The present disclosure pertains to the measurement of the motion of valves of an internal combustion engine, and in particular to the measurement of the motion (i.e. the lift) of a cylinder valve (i.e. a valve allowing intake and exhaust from the cylinder) of an internal combustion engine.

BACKGROUND

Valve motion measurement is commonly performed during engine tests, but serial equipment for continuous valve lift monitoring can be required for those applications with variable valve opening systems. Typically, a sensor (generally a proximity or laser sensor) is pointed to the valve head to measure the movement of the valve. However, in order to install these sensors, holes should be machined within the cylinder head, to position the sensor supporting elements. This is a long, complex and costly process. Furthermore, on typical valve motion measurements for development purpose, the sensor points towards the upper part of the valve head, which is filleted. Since the sensors require a flat target surface, a properly machined valve should be used during tests.

The valve head is subsequently weakened and this prevents tests to be run with combustion, meaning that only measurements on test rigs are commonly allowed. In addition, the preparation of the cylinder head and valves for the test can take a relatively long time, and the modified valves may not behave exactly as serial (standard) components. Due to the modifications required by the standard approach, all the components used for testing (cylinder head, valve assembly, valve actuation) have to be considered as disposable with subsequent hardware costs.

Still within the standard way to test valve motion, the sensor can be pointed towards the combustion face of the valve. The valve shall not be modified, but the positioning of the sensor requires the cylinder block to be removed and this obviously prevents all tests with combustion. Actually this is a general limit for these kind of tests, because modifications in the engine hardware may in fact cause oil or fuel leakages. Operations on the sensor (e.g. the setting of the "zero" position of the valve) after the sensor is in place are also usually uncomfortable, because of tight room available, especially if the engine is already assembled. Moreover, the sensor can be damaged during combustion due to too high temperatures.

With such an approach, tests without combustion cannot provide a detailed picture of the valve train performance of the real engine, and specifically of the valve opening and closing dynamics. As an alternative, indirect measurement of the position of the valve (e.g. by strain gauges mounted on valve train components) have proven not to be enough reliable, in particular because of the difficulties in the interpretation of the output of these kinds of sensors.

SUMMARY

In accordance with the present disclosure, a solution for measuring the motion of a valve of an internal combustion engine is provided that allows minimal modification to the engine (and in particular to the cylinder head) itself. Such a solution might be eligible for serial (standard) valve motion measurement with standard application being converted to variable valve lift. The present disclosure also provides a solution for measuring the motion of a valve of an internal combustion engine during combustion and a solution for measuring the motion of a valve of an internal combustion engine wherein a sensor is not damaged during testing.

According to an embodiment, a valve motion measurement assembly for a cylinder valve of an internal combustion engine, provided with a valve stem and with a valve head, includes a valve position sensor, a supporting bracket provided with at least one sensor seat for the valve position sensor. The valve motion measurement assembly further includes a sensor target element configured to be coupled, at a distance from the valve head, to the valve stein to follow the motion of the valve. The valve position sensor interacts (cooperates) with the sensor target element for determining the position of the valve. Advantageously, the supporting bracket can be easily mounted (e.g. on top of the cylinder head) to the internal combustion engine. Moreover, the sensor is placed far from the combustion chamber of the engine, so that test under combustion can be carried out while monitoring the position of the cylinder valve. The motion measurement assembly includes a target element coupled to the valve stem of the cylinder valve at a distance from the valve head. As a result, the sensor can easily monitor the motion of the target element, and thus the motion of the cylinder valve.

According to an embodiment, the supporting bracket includes at least one fastener hole for a fastener, to couple the supporting bracket to a cylinder head of the internal combustion engine. In particular, a short threaded hole placed on top of the cylinder head of the internal combustion engine can be used to mount the valve motion measurement assembly to the cylinder head. The internal configuration of the cylinder head is thus not modified. Moreover, because of this, the motion measurement assembly can be properly used with different kinds of cylinder heads, i.e. with different kinds of internal combustion engines.

According to an embodiment, at least one sensor seat is arranged at a different height with respect to at least one fastener hole. Thanks to this, the sensor can be properly positioned in operative condition in a simple and effective manner. In particular, the sensor can be easily arranged in a position where it does not interfere with the operation of the valve and, at the same time, it can detect the position of the valve itself.

According to an embodiment, at least one fastener hole is provided with an axis parallel to an axis of at least one sensor seat. Preferably the fastener hole(s) and the sensor seat(s) are all parallel to each other. This provides for a particularly simple positioning of the sensors.

According to an embodiment, the supporting bracket includes a central portion provided with the fastener hole and two side portions provided with a sensor seat. Thanks to this, the valve motion measurement assembly can be placed between two cylinder valves, to monitor the motion of both the cylinder valves.

According to an embodiment, the side portions are parallel to the central portion.

According to an embodiment, the target element is provided with a target surface, preferably the target surface being substantially flat. A particularly effective operation of the sensor can thus be assured, when it is pointed towards the target surface.

According to an embodiment, the target element includes a valve spring retainer. Thanks to this, the target element can be easily mounted on the valve stem. Furthermore, a spring retainer is needed for the operation of the cylinder valve, so that the target element can be provided with two functions. Moreover, the target element does not interfere with the operation of the valve (e.g. it substantially does not add weight to the valve) but, on the contrary, it is useful for the latter.

According to an embodiment, the target element includes a retainer tab provided with the target surface. Cooperation between the sensor and the target surface can thus be provided in a particularly easy and effective manner.

According to an embodiment, the target surface is substantially parallel to an upper surface of the valve spring retainer. A particularly simple relationship between the position of the target surface sensed by the sensor and the position of the valve can thus be established.

According to an embodiment, the supporting bracket is provided with a tab seat configured to partially surround the retainer tab to limit relative rotation between the supporting bracket and the target element, e.g. the valve spring retainer. The retainer tab may be contained within two guides. The guides are part of the design of support bracket, with the aim of preventing the tab to rotate out of the sensor reading range. Possible misalignments between the target surface and the sensor are thus avoided. According to an embodiment, the valve spring retainer is in one piece with the retainer tab. The tab can thus be obtained directly during production of the valve spring retainer. Furthermore, minimum weight (i.e. limited to the weight of the tab) is added to the valve with respect to a conventional valve spring retainer.

According to an embodiment, the target element includes a laminar element coupled to the valve spring retainer, the laminar element being provided with the retainer tab. In these embodiments, a retainer tab can be easily applied to traditional valve spring retainers.

According to an embodiment, the retainer tab is provided with a rounded border. Presence or sharp edge is avoided to prevent damages to the retainer tab and/or to the tab seat when the two elements contact each other. According to an embodiment, the width of the tab seat is greater than the width of the retainer tab to provide clearance in the coupling between the two elements. Such a clearance reduces friction during the movement of the target element with respect to tab seat along the valve stem.

An embodiment of the present disclosure further provides for an internal combustion engine including a cylinder head, at least one cylinder valve provided with a valve stem and with a valve head, and a valve motion measurement assembly fastened to the cylinder head, for example by at least one fastener. The valve motion assembly includes a valve position sensor, a supporting bracket provided with at least one sensor seat for the valve position sensor, and a sensor target element coupled to the valve stem at a distance from the valve head. According to an embodiment, the internal combustion engine is provided with a seat for the valve motion measurement assembly, provided with at least one protruding portion coupled to a lateral surface of the supporting bracket to orientate the valve motion measurement assembly with respect to the cylinder head.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
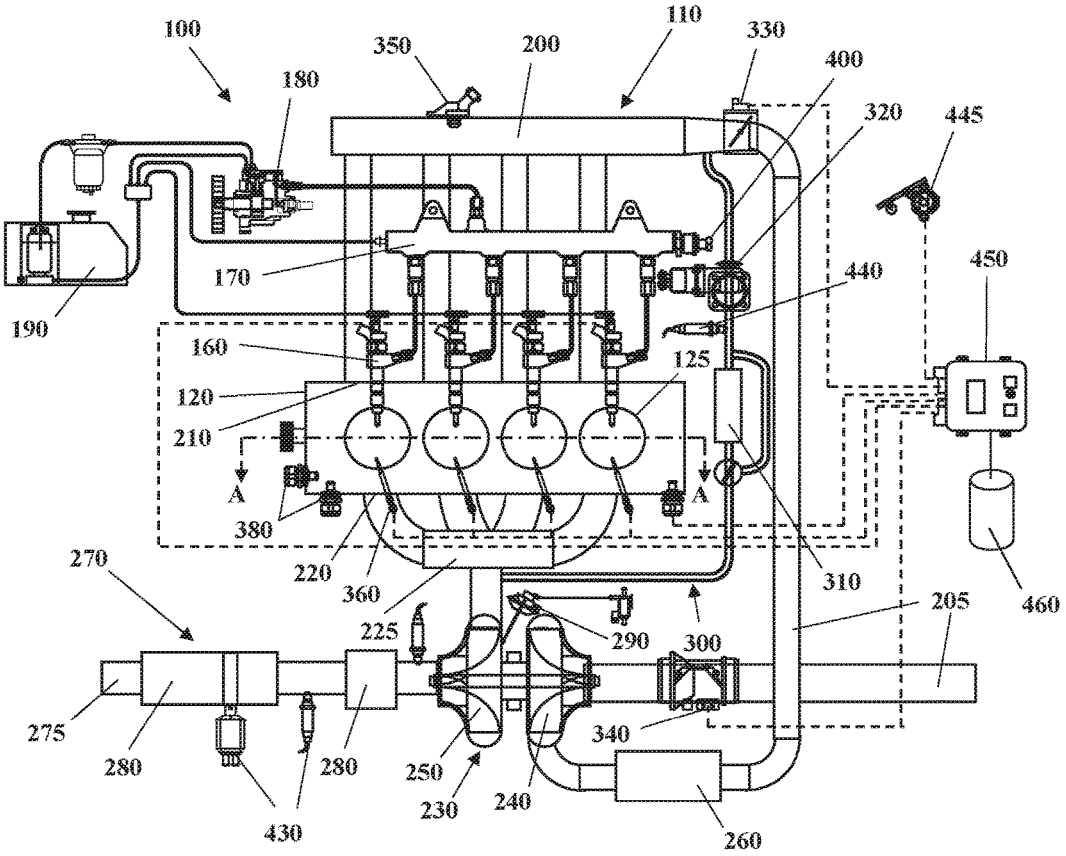
FIG. 1 shows an embodiment of an automotive system including an internal combustion engine.
Figure 2:
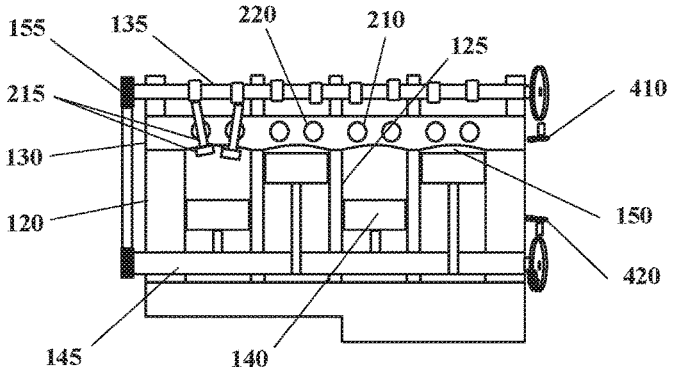
FIG. 2 is a cross-section according to the plane A-A of an internal combustion engine belonging to the automotive system of FIG. 1.
Figure 3:
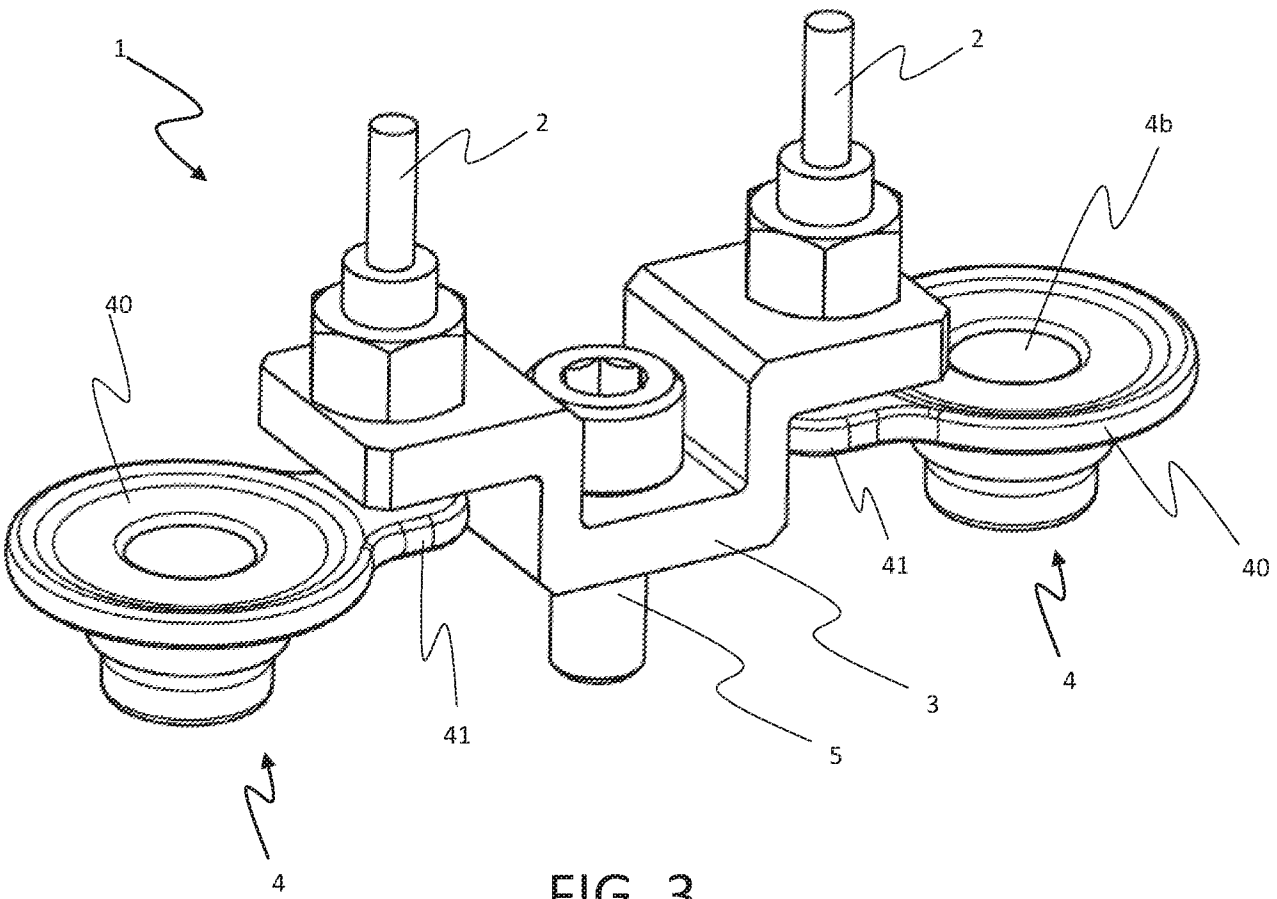
FIG. 3 is a perspective view of a valve motion measurement assembly according to an embodiment of the present disclosure.

Some embodiments may include an automotive system 100, as shown in FIGS. 1 and 2, that includes an internal combustion engine (ICE) 110 having an engine block 120 defining at least one cylinder 125 having a piston 140 coupled to rotate a crankshaft 145. A cylinder head 130 cooperates with the piston 140 to define a combustion chamber 150. A fuel and air mixture (not shown) is disposed in the combustion chamber 150 and ignited, resulting in hot expanding exhaust gasses causing reciprocal movement of the piston 140. The fuel is provided by at least one fuel injector 160 and the air through at least one intake port 210. The fuel is provided at high pressure to the fuel injector 160 from a fuel rail 170 in fluid communication with a fuel pump 180 that increase the pressure of the fuel received from a fuel source 190. Each of the cylinders 125 has at least two cylinder valves 215, actuated by the camshaft 135 rotating in time with the crankshaft 145. The cylinder valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

The air may be distributed to the air intake port(s) 210 through an intake manifold 200. An air intake duct 205 may provide air from the ambient environment to the intake manifold 200. In other embodiments, a throttle body 330 may be provided to regulate the flow of air into the manifold 200. In still other embodiments, a forced air system such as a turbocharger 230, having a compressor 240 rotationally coupled to a turbine 250, may be provided. Rotation of the compressor 240 increases the pressure and temperature of the air in the duct 205 and manifold 200. An intercooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. The exhaust gases exit the turbine 250 and are directed into an exhaust system 270. This example shows a variable geometry turbine (VGT) with a VGT actuator 290 arranged to move the vanes to alter the flow of the exhaust gases through the turbine 250. In other embodiments, the turbocharger 230 may be fixed geometry and/or include a waste gate.

The exhaust system 270 may include an exhaust pipe 275 having one or more exhaust aftertreatment devices 280. The aftertreatment devices may be any device configured to change the composition of the exhaust gases. Some examples of aftertreatment devices 280 include, but are not limited to, catalytic converters (two and three way), oxidation catalysts, lean $NO_x$ traps, hydrocarbon adsorbers, selective catalytic reduction (SCR) systems, and particulate filters. Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

The automotive system 100 may further include an electronic control unit (ECU) 450 in communication with one or more sensors and/or devices associated with the ICE 110. The ECU 450 may receive input signals from various sensors configured to generate the signals in proportion to various physical parameters associated with the ICE 110. The sensors include, but are not limited to, a mass airflow and temperature sensor 340, a manifold pressure and temperature sensor 350, a combustion pressure sensor 360, coolant and oil temperature and level sensors 380, a fuel rail pressure sensor 400, a cam position sensor 410, a crank position sensor 420, exhaust pressure and temperature sensors 430, an EGR temperature sensor 440, and an accelerator pedal position sensor 445. Furthermore, the ECU 450 may generate output signals to various control devices that are arranged to control the operation of the ICE 110, including, but not limited to, fuel injectors 160, the throttle body 330, the EGR Valve 320, the VGT actuator 290, and the cam phaser 155. Note, dashed lines are used to indicate communication between the ECU 450 and the various sensors and devices, but some are omitted for clarity.

Turning now to the ECU 450, this apparatus may include a digital central processing unit (CPU) in communication with a memory system 460, or data carrier, and an interface bus. The CPU is configured to execute instructions stored as a program in the memory system 460, and send and receive signals to/from the interface bus. The memory system 460 may include various storage types including optical storage, magnetic storage, solid state storage, and other non-volatile memory. The interface bus may be configured to send, receive, and modulate analog and/or digital signals to/from the various sensors and control devices.

Instead of an ECU 450, the automotive system 100 may have a different type of processor to provide the electronic logic, e.g. an embedded controller, an onboard computer, or any processing module that might be deployed in the vehicle.

With reference to FIGS. 3-13, a valve motion measurement assembly includes a valve position sensor 2, a supporting bracket 3 and a sensor target element 4. The valve position sensor 2 is an element capable of measuring the distance of an object from a reference position (known as "zero" or "zero position"). Sensors of this kind are known, e.g. proximity sensors or laser sensors can be used. These types of sensors, e.g. proximity sensors, generally direct a signal (e.g. an infrared radiation) against a target (e.g. the sensor target element 4 of the present embodiments) and read the return signal form the target. In a known manner, the proximity sensor is capable of inferring the position of the object from the above mentioned return signal.

In general, the valve position sensor 2 is able to determine the position (i.e. the distance) of the sensor target element 4 without physical contacting the sensor target element 4. Typically, in order to effectively operate, the valve position sensor 2 should be properly directed towards the target element 4. In other words, the sensor target element 4 and the valve position sensor 2 should be placed with a certain orientation one with respect to the other, so as to assure a proper operation of the valve position sensor 2, preferably without interfering objects. As further discussed below, this orientation is provided by the supporting bracket 3.

Figure 4:
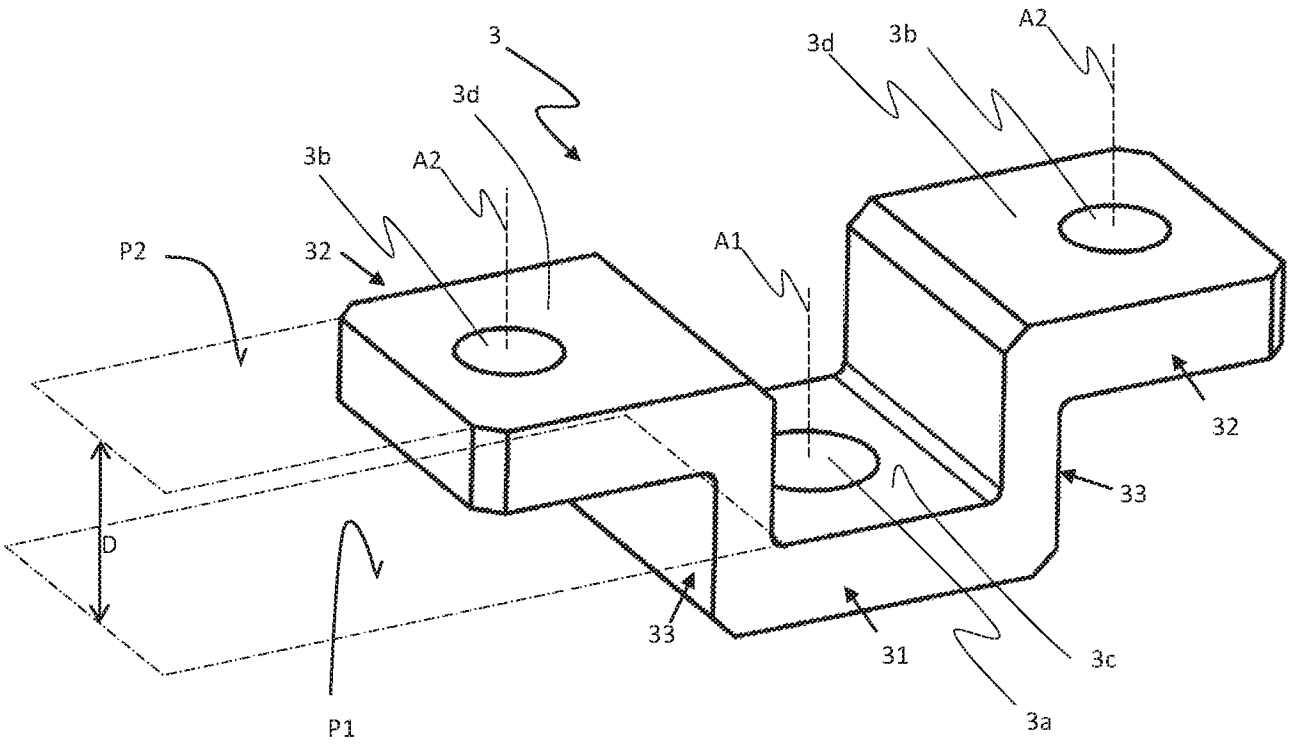
FIG. 4 is a perspective view of a supporting bracket of the valve motion measurement assembly of FIG. 3.

With particular reference to FIG. 4, according to a possible embodiment, the supporting bracket 3 is provided with at least one fastener hole 3*a* and with at least one sensor seat 3*b*. A supporting bracket of a preferred embodiment, shown in the figures, is provided with one fastener hole 3*a* and with a couple of sensor seats 3*b*. With reference to the shown embodiment, the fastener hole 3*a* can be interposed between the sensor seats 3*b*. In other words, the supporting bracket 3 can include a central portion 31 provided with the fastener hole 3*a* and two side portions 32, each provided with a sensor seat 3*b*.

Different embodiments can be provided with a different number of fastener holes (or different fastener types allowing the supporting bracket to be coupled to the cylinder head) and/or with a different number of sensor seats. For easiness of description, reference to one fastener hole 3*a* and to one sensor seat 3*b* will be made. The following description applies as well to embodiments with more fastener holes and/or sensor seats.

In an embodiment, the fastener hole 3*a* is a through hole to allow a fastener to pass through the supporting bracket 3. Furthermore, the sensor seat 3*b* is typically configured as a through opening, crossing (i.e. passing through) the supporting bracket 3. The shape of the sensor seat 3*b* is preferably configured to match the shape of the valve position sensor 2. Typically, the sensor seat 3*b* is a through cylindrical opening, i.e. it is configured like a through hole, too.

According to an embodiment, the axis A1 of the fastener hole 3*b* is substantially parallel to the axis A2 of the sensor seat 3*b*. In general, the axis A1 and A2 are oriented so that, when the supporting bracket is coupled to the internal combustion engine 110 by a fastener 5, the axis A2 is directed against the target element 4, preferably orthogonally with respect to a target surface 4*a* of the target element.

According to an embodiment, the sensor seat 3*b* is arranged at a different height with respect to the fastener hole 3*a*. In more detail, the upper surface of the supporting bracket 3 (i.e. the surface opposite the surface facing the internal combustion engine 110) includes at least two areas 3*c*, 3*d* arranged on different planes P1, P2. In particular these different planes are spaced one from the other by a distance D at least in the direction of the axis A1 of the fastener hole 3*a*. One area 3*c* is provided with the fastener hole 3*a*, while the other area 3*d* is provided with the sensor seat 3*b*. With reference to the shown embodiment, one area 3*c* is arranged on the central portion 31, while the other area 3*d* is arranged on a side portion 32.

In the shown embodiment, the central portion 31 and the side portions 32 are connected by connecting portions 33 which are inclined with respect to both the central portion 31 and the side portions 32. Typically the side portions 32 and the central portion 31 are parallel one to the other. Furthermore, the connecting portions 33 are preferably substantially orthogonal to both the central portion 31 and the side portions 32.

In general, in embodiments provided with a plurality of fastener holes and/or of sensor seats, the fastener holes are preferably placed at a first height, while the sensor seats are placed at a second height, different from the first height. However, according to the needs, it is not excluded that different fastener holes can be placed at different height between each other. This is also true for the sensor seats.

The target element 4 is an element configured to be coupled to a cylinder valve 215 of the internal combustion engine 110. The valve is provided with a valve stem 215*a* and with a valve head 215*b*. The target element 4 is configured to be coupled to the valve stem 215*a* of the cylinder valve 215. In the shown embodiment, the target element 4 is provided with an opening 4*b*, into which the valve stem 215*a* can be inserted. Other means for coupling the target element 4 to the valve stem can be used in different embodiments.

In general, the target element 4 is configured to be coupled to the cylinder valve 215 so as to follow the movement cylinder valve 215, typically of the valve stem 215*a*, as mentioned. The target element 4 is also provided with a target surface 4*a*, which is preferably flat and, more in general, which is configured to cooperate with the sensor 2. As an example, material and shape of the target surface are chosen so as to properly interact (and reflect) the signal emitted by a proximity sensor. Preferably, the target surface 4*a* is parallel to the upper surface of the target element 4, so as to simplify the relationship between the distance d1 between the valve position sensor 2 and the target element 4, and the position of the cylinder valve 215.

According to a preferred embodiment, the target element 4 includes a valve spring retainer 40. Thanks to this, there is no need to couple an external element to the cylinder valve 215, because the target element 4 is an element of the valve itself. In fact, the valve spring retainer 40 is coupled to the valve stem 215*a* and to a valve spring 215*c*. As known, the valve spring 215*c* assures contact between the cylinder valve 215 and the actuator of the cylinder valve 215, which is typically the camshaft 135.

Figure 5B:
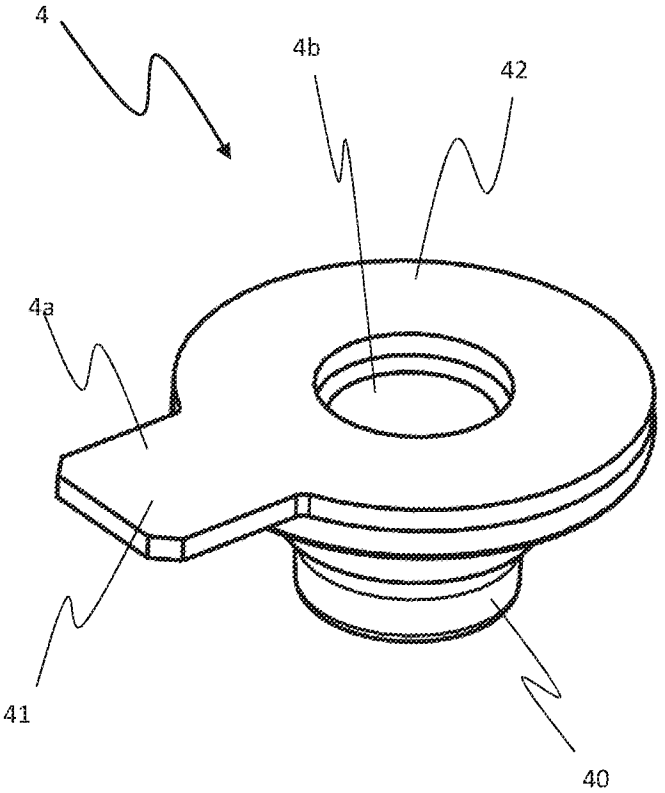
FIG. 5*b* is a perspective view of a target element of a valve motion measurement assembly according to a further embodiment.
Figure 5A:
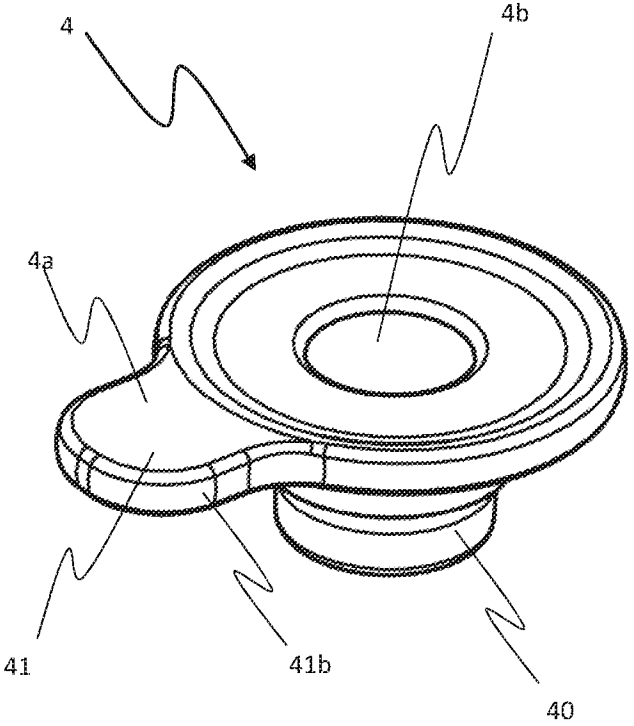
FIG. 5*a* is a perspective view of a target element of the valve motion measurement assembly of FIG. 3.

As mentioned, the target element 4 is preferably provided with a target surface 4*a*. In the shown embodiment, the target surface 4*a*is provided on a retainer tab 41. The retainer tab 41 is typically arranged to extend laterally from the border (i.e. the perimeter in plan view) of the valve spring retainer 40. In the embodiment of FIG. 5*a*, the retainer tab 41 is in one piece with the valve spring retainer 40. Alternatively, the retainer tab can be arranged on a different element, coupled to the valve spring retainer. As an example, in the embodiment of FIG. 5*b*, a laminar (or leaf) element 42 provided with the retainer tab 41 is coupled to the spring retainer 40. In particular, in this embodiment, a traditional valve spring retainer can be used. Typically, the laminar element can be arranged on top of the valve spring retainer. In general, a retainer tab 41 can be coupled to a valve spring retainer 40 so as to obtain a target element 4. According to an embodiment, the retainer tab 41 is provided with a lateral rounded border 41*b*, as for example in the embodiment shown in FIG. 5*a*. In other words, the lateral border 41*b* is free from sharp edges.

Figure 6:
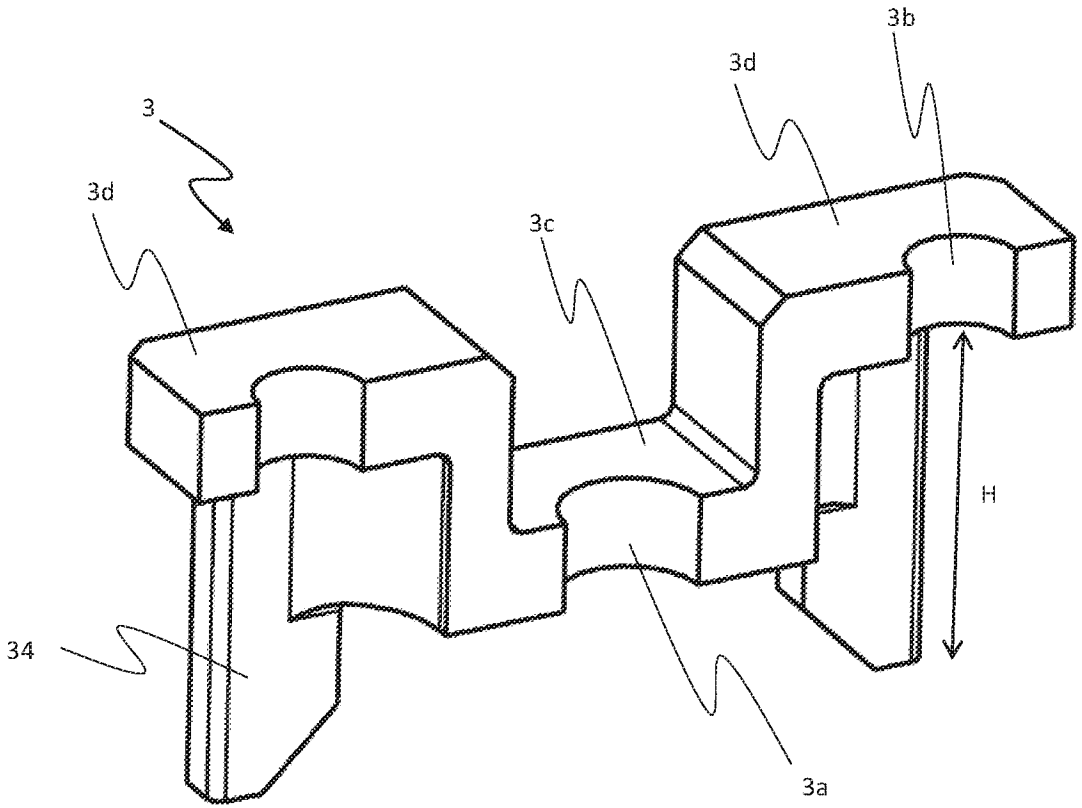
FIG. 6 is a sectional perspective view of a supporting bracket of the valve motion measurement assembly according to a further embodiment.
Figure 7:
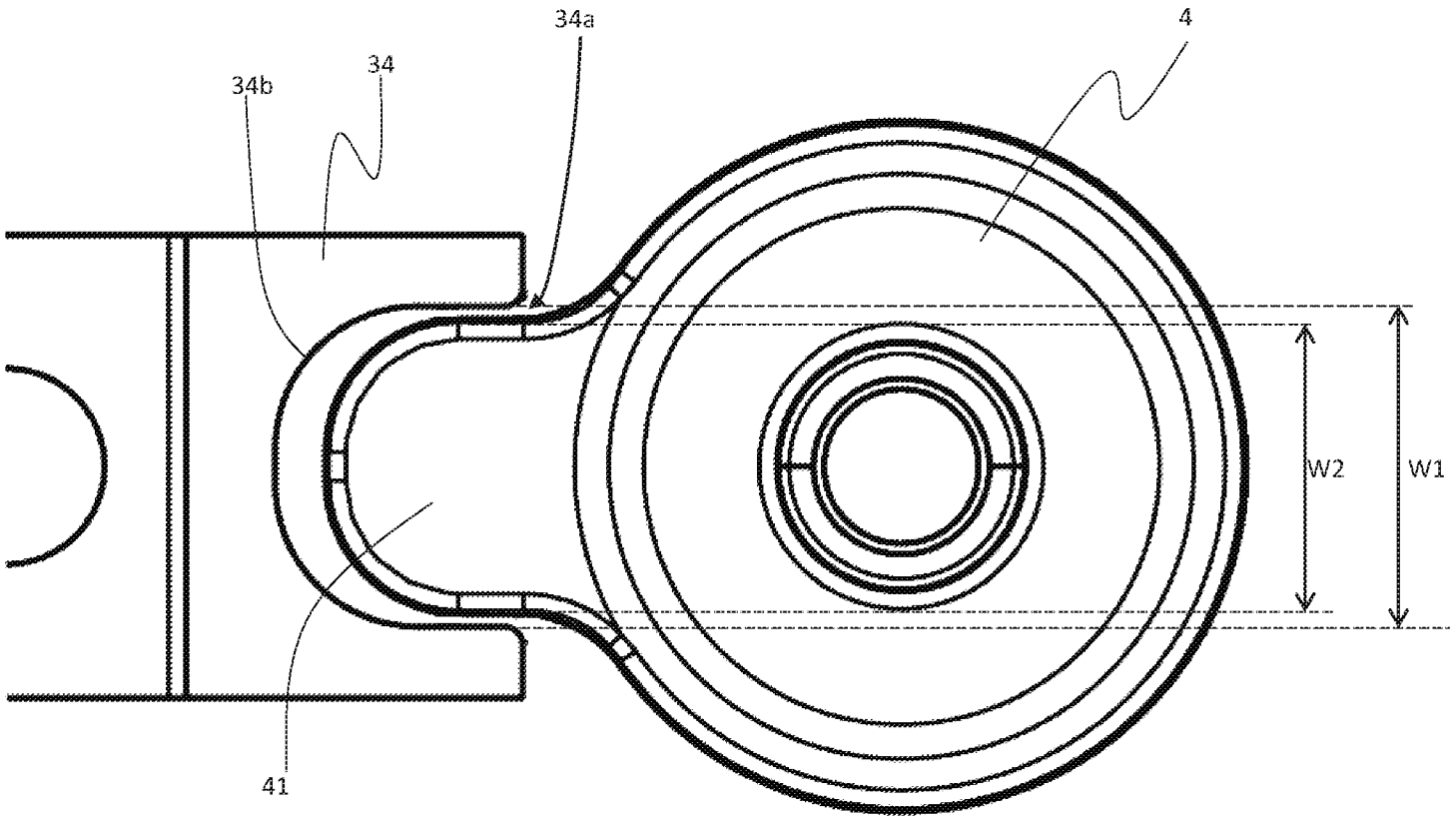
FIG. 7 is a top view of the target element of FIG. 4 coupled to the supporting bracket of FIG. 6.
Figure 8:
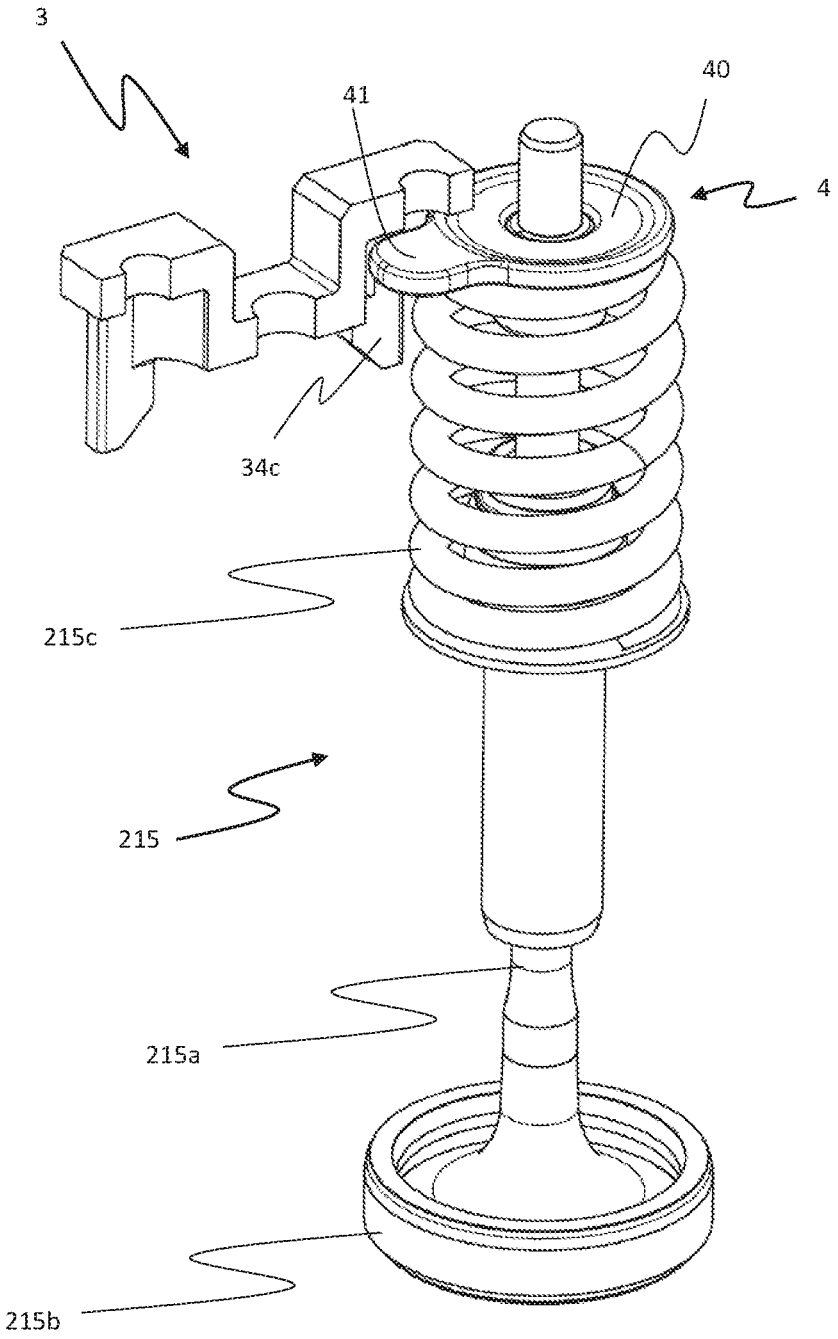
FIG. 8 is a perspective view of the supporting bracket of the assembly of FIG. 7 coupled to a cylinder valve.
Figure 9:
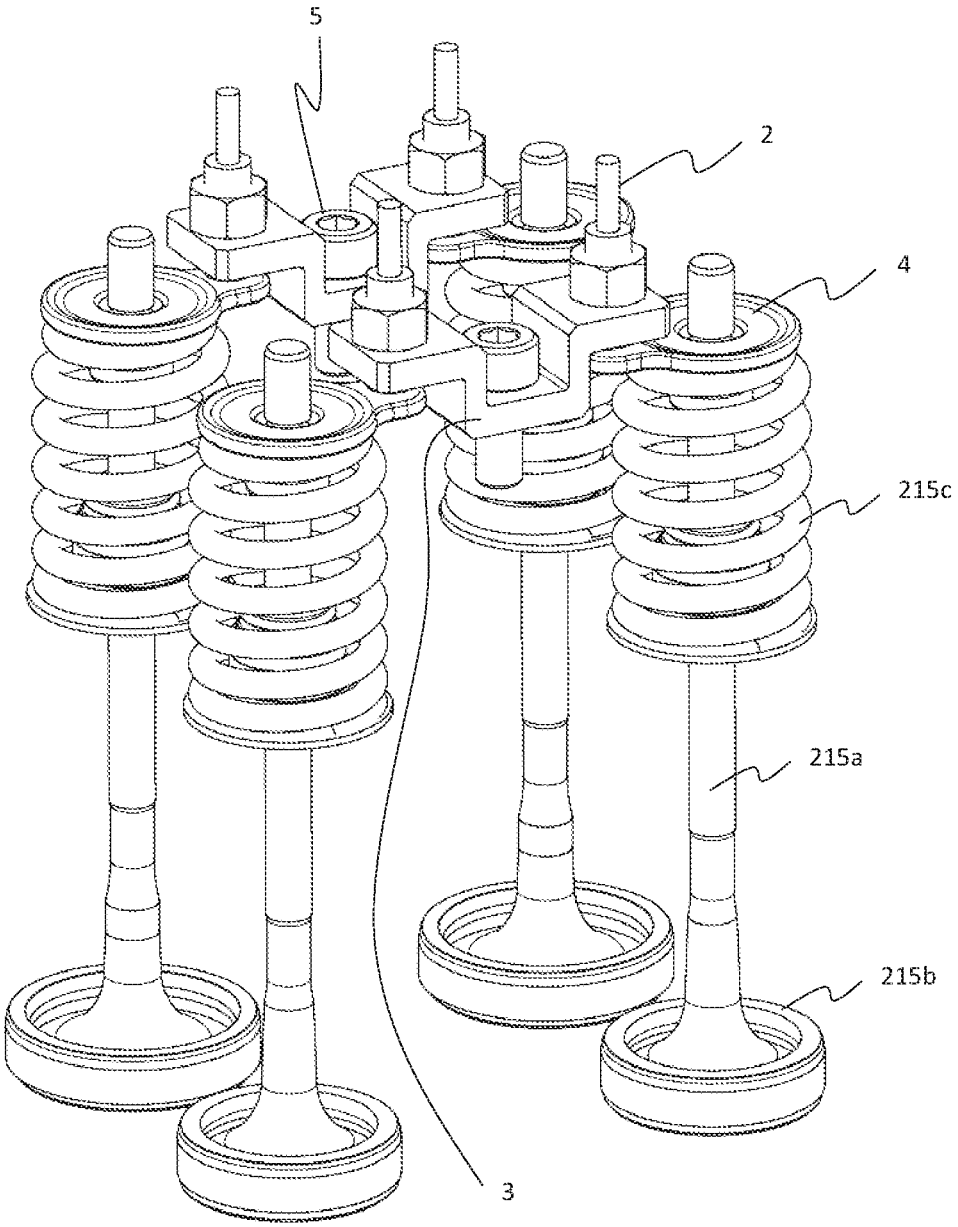
FIG. 9 is a perspective view of two valve motion measurement assembly according to FIG. 1, each coupled to two cylinder valves.
Figure 10:
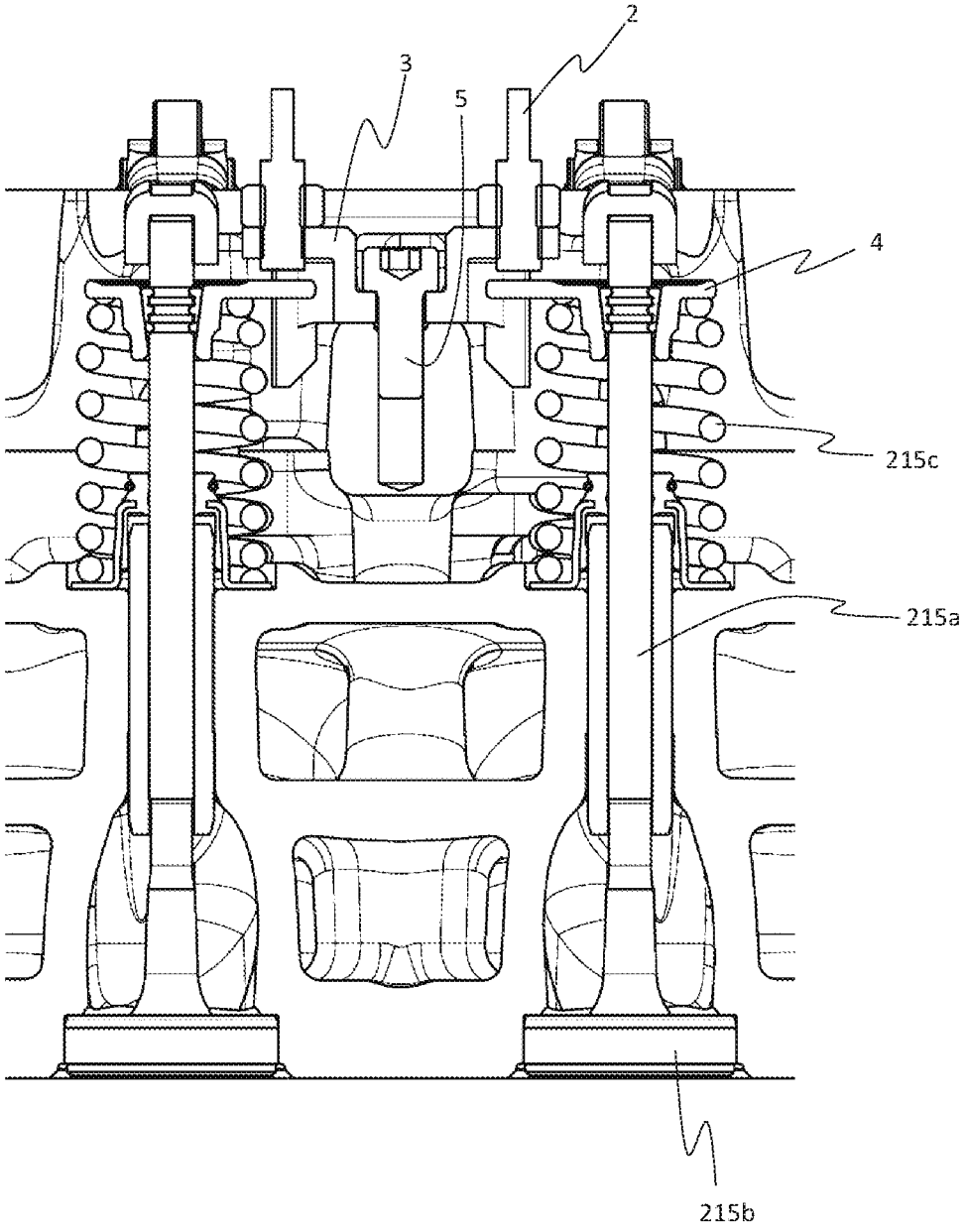
FIG. 10 is a frontal sectional view of a valve motion measurement assembly coupled to the cylinder head of an internal combustion engine.
Figure 11:
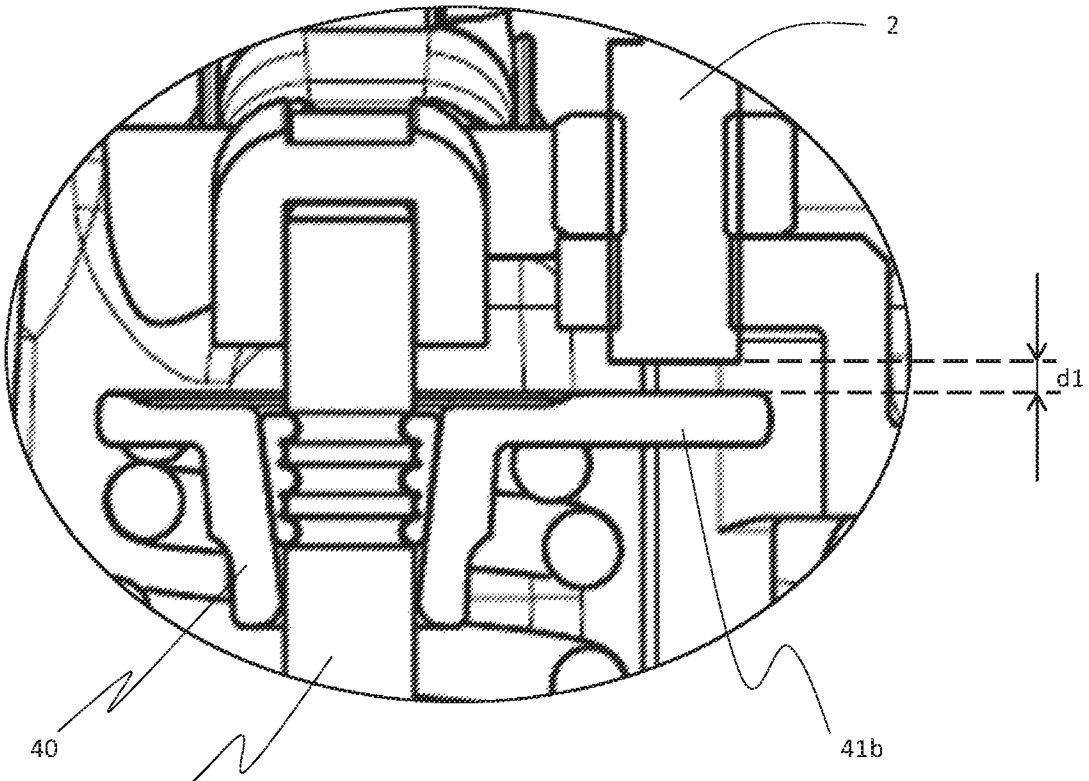
FIG. 11 is an enlarged partial view of FIG. 10.
Figure 12:
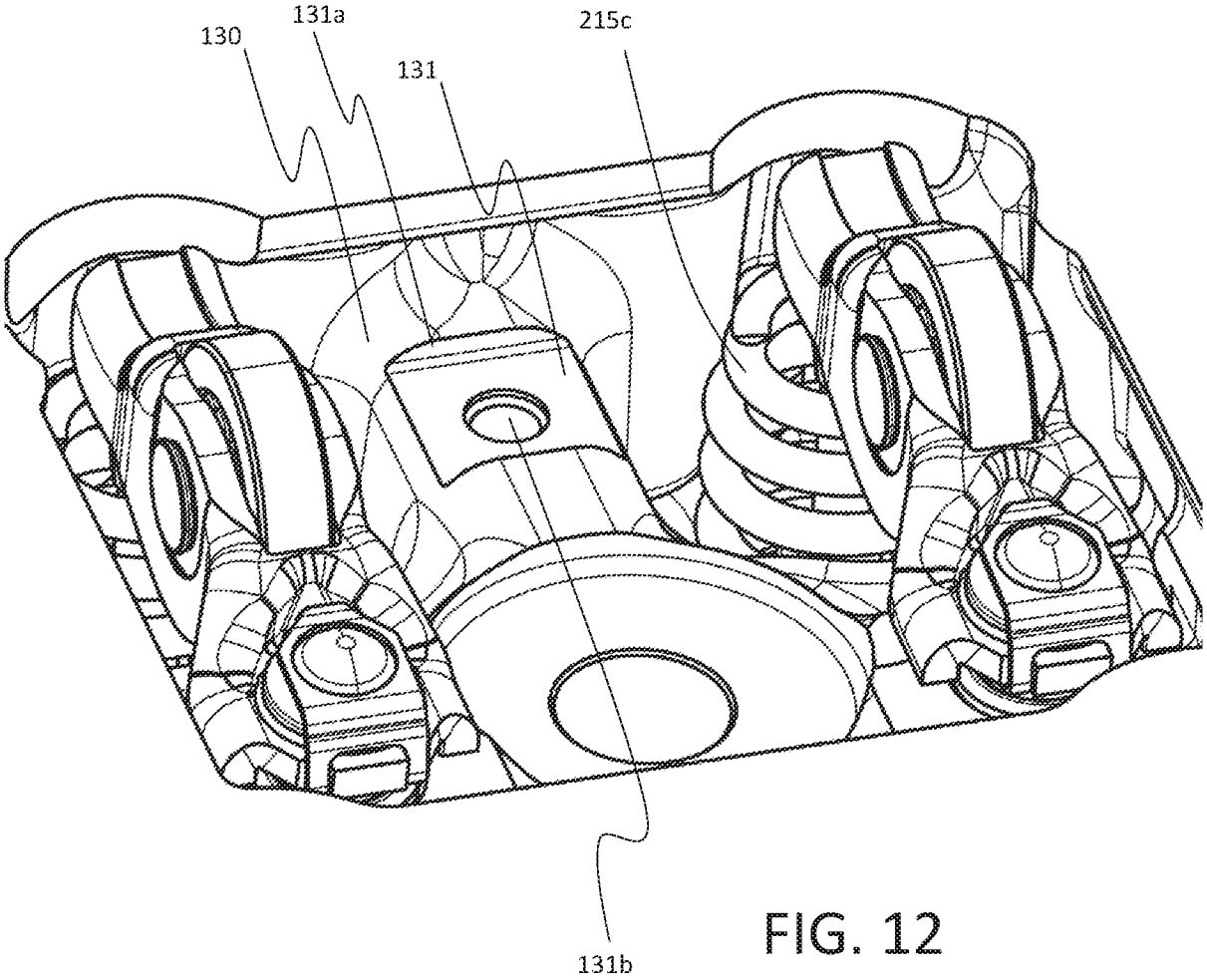
FIG. 12 is a top perspective view of a top portion of a cylinder head of an internal combustion engine.
Figure 13:
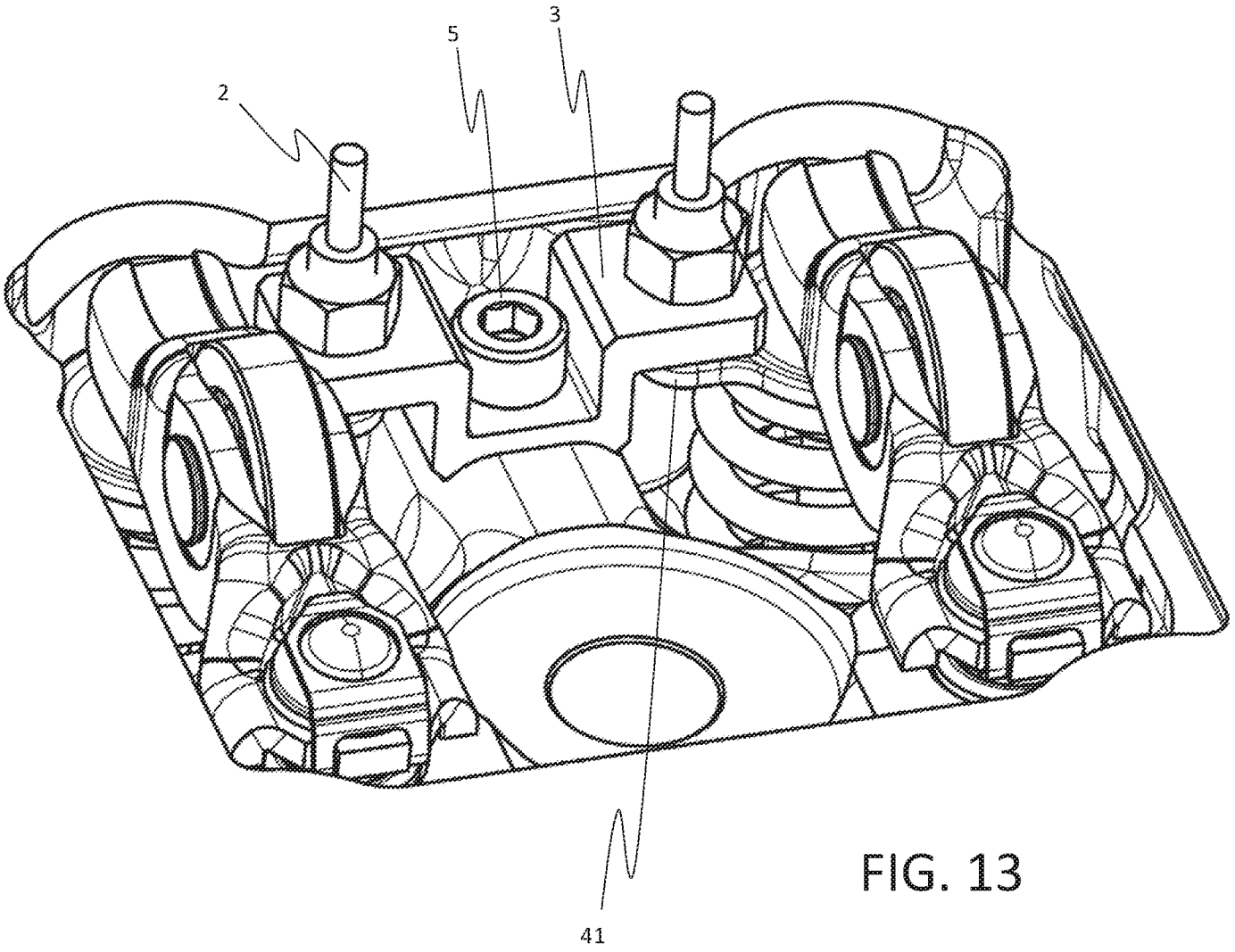
FIG. 13 is a top perspective view of the valve motion measurement assembly of FIG. 1 coupled to the cylinder head of FIG. 12.

In an embodiment, shown in FIGS. 6, 7 and 8, the supporting bracket 3 can be provided with a tab seat 34. The tab seat 34 is configured to partially embrace the retainer tab 41. In more detail, the tab seat 34 can be provided with an open portion 34*a*, to allow insertion of the retainer tab 41 into the retainer seat 34, and with a lateral surface 34*b* that can engage the tab seat 34, to limit relative rotation between the tab seat 34 and the retainer tab 41. In an embodiment, shown in the figures, the tab seat 34 is provided with a substantially U shape in plant view.

The tab seat 34 is dimensioned to provide an engagement with a certain clearance with the retainer tab 41*b*. In other words, dimensions of the tab seat 34 are slightly greater than the dimension of the retainer tab 41. Typically, the tab seat 34 has a width W1 that is greater than the width W2 of the retainer tab 41. Preferably, the difference between the two widths W1 and W2 is quite smaller e.g. not more than one millimeter) than the width W1 of the tab seat 34. In the shown embodiment, the tab seat 34 includes one or more lateral protrusions 34*c*, protruding towards the internal combustion engine 110. The height H of the lateral protrusion(s) 34*c* of the tab seat 34, (i.e. the dimension of the tab seat 34 measured along a direction parallel to the axis A1 of the fastener hole 3*a*) has to be greater than the maximum lift of the cylinder valve 215, in order to avoid valve train damage and provide engagement between the tab seat 34 and the retainer tab 41*b* for the whole movement of the cylinder valve 215.

With reference to FIGS. 10-13, the relative positioning between the internal combustion engine 110 and the valve motion measurement assembly 1 will be now discussed. In particular, the valve motion measurement assembly 1 is mounted to the cylinder head 130 of the internal combustion engine 110, The cylinder head 130 is typically provided with a seat 131 for the valve motion measurement assembly. The seat 131 typically includes one or more protruding portions 131*a*, to property orientate the valve motion measurement assembly 1. The protruding portions 131*a* typically act as shoulders, i.e. they engage a lateral surface of the valve motion measurement assembly 1, typically of the supporting bracket 3, so as to avoid rotation between the valve motion measurement assembly 1 and the cylinder head 130.

In the shown embodiment, two opposite protruding portions 131*a* are shown. Different embodiment can be provided e.g. with only one protruding portion 131*a*. According to an embodiment, the seat 131 is also provided with a threaded hole 131*b* for the fastener 5 (e.g. a screw), to allow coupling between the valve motion measurement assembly 1 and the cylinder head 130. Preferably, the seat 131 is obtained on an inert rib 132 (i.e. a rib with no structural functions) of the cylinder head 130. No further modifications of the cylinder head 130 are needed to mount the valve motion measurement assembly 1 to the cylinder head 130.

It should be noted that different fastener types can be provided to allow coupling between the valve motion measurement assembly 1, and in particular between the supporting bracket and the cylinder head 130. In general, the valve motion measurement assembly 1 is coupled at the top portion of the cylinder head 130. With "top portion" it is meant the portion of the cylinder head 130 opposite to the cylinders 125. Preferably, the valve motion measurement assembly 1 is coupled to a top surface of the cylinder head 130, i.e. a surface opposite to the surface of the cylinder head 130 facing the cylinders 125. Once mounted, the valve position sensor 2 of the valve motion measurement assembly 1 is directed towards the target element 4, so as to measure the distance d1 between the valve position sensor 2 and the target element 4.

During operation, the cylinder valve 215 is alternatively raised and lowered by the engagement with the rotating camshaft 135. The target element 4 moves together with the cylinder valve 215, so that the distance d1 between the valve position sensor 2 and the target element 4 is varied. The valve position sensor 2 monitors the above mentioned distance d1. From the distance d1 between the valve position sensor 2 and the target element 4 it is possible to infer the position of the cylinder valve 215.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A valve motion measurement assembly for a cylinder valve of an internal combustion engine having a valve stem and a valve head, the assembly comprising:

a valve position sensor;

a supporting bracket having a sensor seat for the valve position sensor, the supporting bracket having a tab seat; and a sensor target element configured to be coupled to the valve stem to follow the motion of the cylinder valve, the sensor target element including a retainer tab provided with a target surface, the tab seat configured to partially surround the retainer tab for limiting relative rotation between the supporting bracket and the sensor target element;

wherein the valve position sensor interacts with the target surface of the sensor target element for determining the position of the cylinder valve.

2. The valve motion measurement assembly according to claim 1, further comprising at least one fastener received in a fastener hole formed in the supporting bracket and configured to couple the supporting bracket to a cylinder head of the internal combustion engine.

3. The valve motion measurement assembly according to claim 2, wherein the sensor seat is arranged at a different height with respect to the fastener hole on the supporting bracket.

4. The valve motion measurement assembly according to claim 2, wherein the fastener hole is provided with an axis parallel to an axis of the sensor seat.

5. The valve motion measurement assembly according to claim 2, wherein the valve position sensor is a first valve position sensor;

further comprising a second valve position sensor;

wherein the supporting bracket comprises a central portion having the fastener hole formed therein; and wherein the supporting bracket includes a first side portion that extends from the central portion, the first side portion including a first sensor seat formed therein for supporting the first valve position sensor; and wherein the supporting bracket includes a second side portion that extends from the central portion, the second side portion including a second sensor seat formed therein for supporting the second valve position sensor.

6. The valve motion measurement assembly according to claim 1, wherein the target surface is substantially flat.

7. The valve motion measurement assembly according to claim 1, wherein the target element comprises a valve spring retainer.

8. The valve motion measurement assembly according to claim 1, wherein the target element comprises a valve spring retainer; and wherein the target surface is substantially parallel to an upper surface of the valve spring retainer.

9. The valve motion measurement assembly according to claim 8, wherein the valve spring retainer is in one piece with the retainer tab.

10. The valve motion measurement assembly according to claim 8, wherein the target element comprises a laminar element coupled to the spring retainer, the laminar element being provided with the retainer tab.

11. The valve motion measurement assembly according to claim 8, wherein the retainer tab is provided with a rounded border.

12. The valve motion measurement assembly according to claim 8, wherein a width of the tab seat is greater than a width of the retainer tab to provide clearance in the coupling between the tab seat and the retainer tab.

13. An internal combustion engine comprising:

a cylinder head;

at least one cylinder valve having a valve stem and a valve head; and a valve motion measurement assembly including a supporting bracket that is fastened to the cylinder head, a valve position sensor attached to the supporting bracket at a sensor seat of the supporting bracket, and a sensor target element with a retainer that is fixedly coupled to the valve stem to follow the motion of the cylinder valve, the supporting bracket having a tab seat the sensor target element including a retainer tab provided with a target surface, wherein the valve position sensor interacts with the target surface of the sensor target element for determining the position of the cylinder valve; and the tab seat having a first width that is greater than a second width of the retainer tab to provide clearance in a coupling between the tab seat and the retainer tab.

14. The internal combustion engine of claim 13, wherein the cylinder head comprises a seat having at least one protruding portion, wherein a lateral surface of the supporting bracket is coupled to the protruding portion to orientate the valve motion measurement assembly with respect to the cylinder head.

15. A valve motion measurement assembly for a first cylinder valve and a second cylinder valve of an internal combustion engine, the first cylinder valve and the second cylinder valve both having a valve stem and a valve head, the assembly comprising:

a first valve position sensor for the first cylinder valve and a second valve position sensor for the second cylinder valve;

a supporting bracket including a central portion configured to be attached to a cylinder head of the internal combustion engine, the supporting bracket including a first side portion that extends from the central portion and that has a first sensor seat for the first valve position sensor, the supporting bracket including a second side portion that extends from the central portion and that has a second sensor seat for the second valve position sensor;

a first sensor target element and a second sensor target element, the first sensor target element configured to be coupled to the valve stem of the first cylinder valve to follow the motion of the first cylinder valve, the second sensor target element configured to be coupled to the valve stem of the second cylinder valve to follow the motion of the second cylinder valve;

the first valve position sensor configured to interact with the first sensor target element for determining the position of the first cylinder valve; and the second valve position sensor configured to interact with the second sensor target element for determining the position of the second cylinder valve.

16. The valve motion measurement assembly of claim 15, wherein the central portion includes a fastener hole; and further comprising a fastener that is received in the fastener hole and configured to attach the central portion to the cylinder head.

17. The valve motion measurement assembly of claim 16, wherein the fastener hole is provided with an axis parallel to an axis of at least one of the first sensor seat and the second sensor seat.

18. The valve motion measurement assembly of claim 15, wherein the central portion is disposed at a different height as compared to at least one of the first sensor seat and the second sensor seat.

19. The valve motion measurement assembly of claim 15, wherein the first sensor target element includes a target surface that is substantially flat; and wherein the first valve position sensor is configured to interact with the target surface for determining the position of the first cylinder valve.

20. The valve motion measurement assembly of claim 15, wherein the first sensor target element includes a valve spring retainer.

* * * * *